United States Patent [19]

Ronci

[11] 4,417,372

[45] Nov. 29, 1983

[54] ADJUSTABLE BUCKLE CONSTRUCTION

[75] Inventor: Fernando M. Ronci, Providence, R.I.

[73] Assignee: F. Ronci Company, Inc., No. Providence, R.I.

[21] Appl. No.: 432,545

[22] Filed: Sep. 29, 1982

[51] Int. Cl.[3] ..... A44B 11/00

[52] U.S. Cl. ..... 24/163 R; 24/197

[58] Field of Search ..... 24/197, 163 R, 182, 24/181, 196

[56] References Cited

U.S. PATENT DOCUMENTS

| | | | |
|---|---|---|---|
| 1,081,610 | 12/1913 | Hazard | 24/197 |
| 1,273,340 | 7/1918 | Eklund | 24/163 R |
| 2,442,266 | 5/1948 | Davis | 24/170 |
| 2,784,472 | 3/1957 | Freysinger | 24/197 |
| 2,804,092 | 8/1957 | Aitchison | 24/170 |
| 2,807,852 | 10/1957 | Rave | 24/197 |
| 3,020,089 | 2/1962 | Monroe | 24/197 |
| 3,063,116 | 11/1962 | Mihalyi | 24/170 |
| 3,165,802 | 1/1965 | Irvin | 24/197 |
| 3,313,300 | 4/1967 | Mathison et al. | 24/200 |
| 3,407,452 | 10/1968 | Abert et al. | 24/197 |

FOREIGN PATENT DOCUMENTS

| | | | |
|---|---|---|---|
| 491812 | 4/1953 | Canada | 24/197 |
| 1328435 | 4/1963 | France | 24/197 |

*Primary Examiner*—Paul J. Hirsch

*Attorney, Agent, or Firm*—Salter & Michaelson

[57] ABSTRACT

An adjustable buckle construction for detachably interconnecting first and second strap end portions is disclosed. A base member of the buckle is connected to the first end portion and includes first and second spaced transverse cross elements and a pair of spaced side walls which interconnect the cross elements. The second strap end portion is adjustably received on a clasp member of the buckle. The clasp member is receivable in locking relation on the base member by inserting it through an open area in the base member from the underside thereof and thereafter pressing it downwardly onto the base member.

1 Claim, 9 Drawing Figures

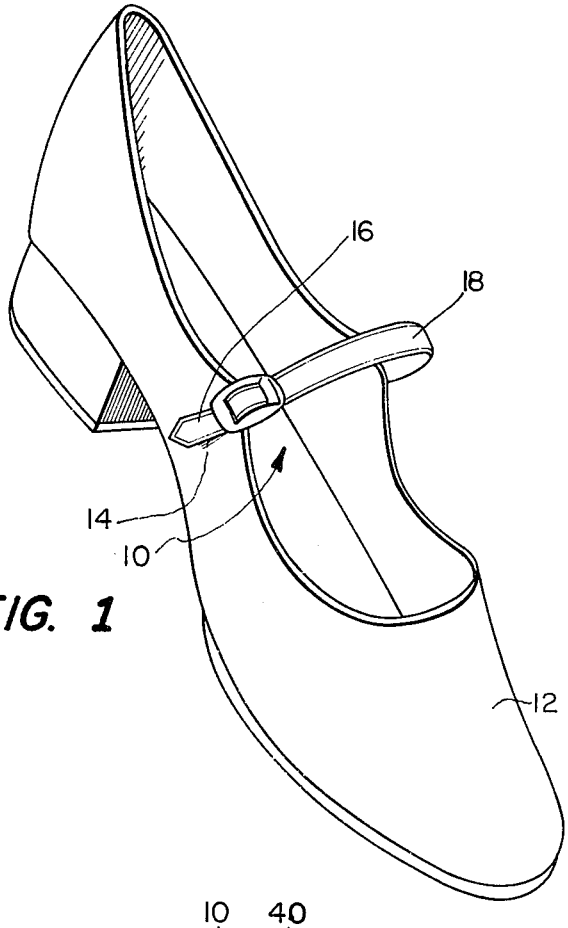
FIG. 1
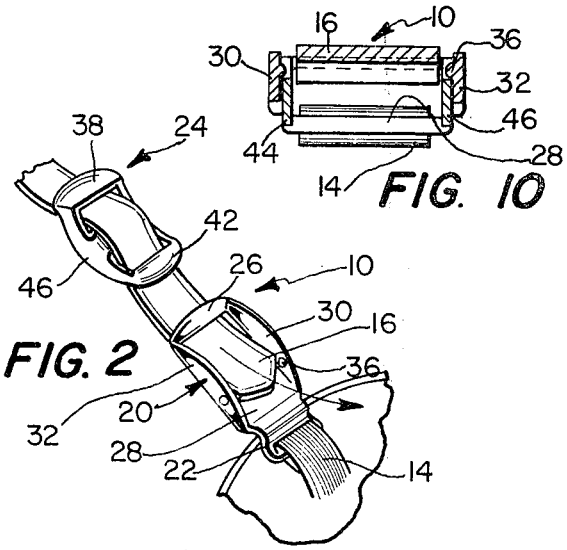
FIG. 2
FIG. 10
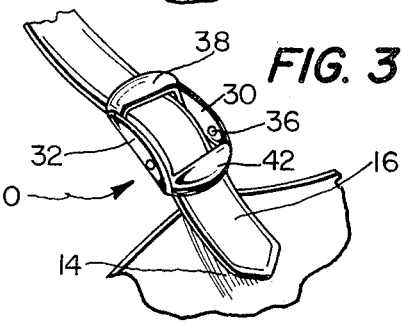
FIG. 3
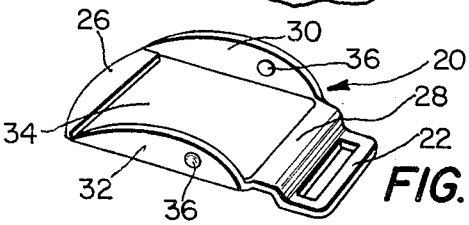
FIG. 5
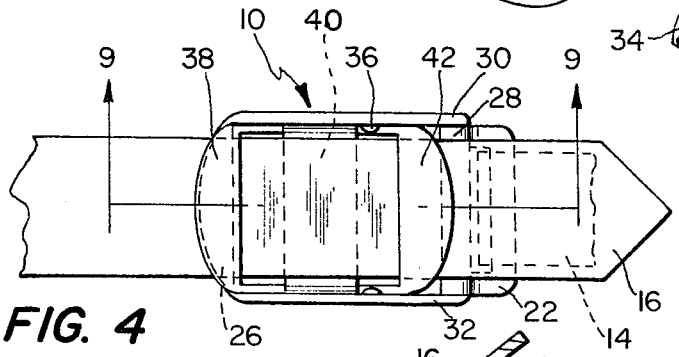
FIG. 4
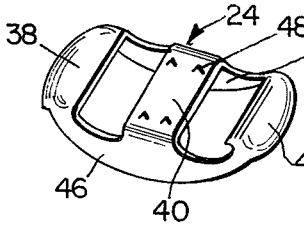
FIG. 6
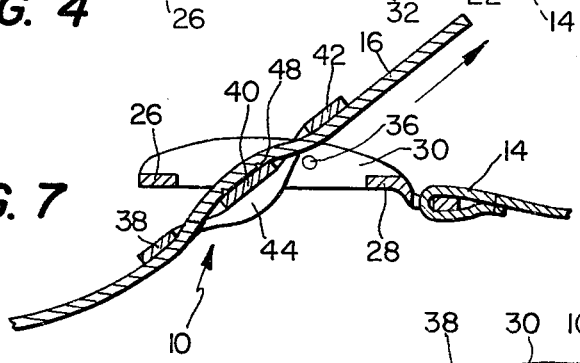
FIG. 7
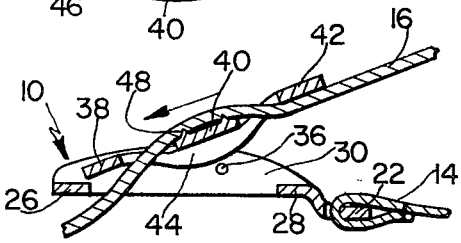
FIG. 8
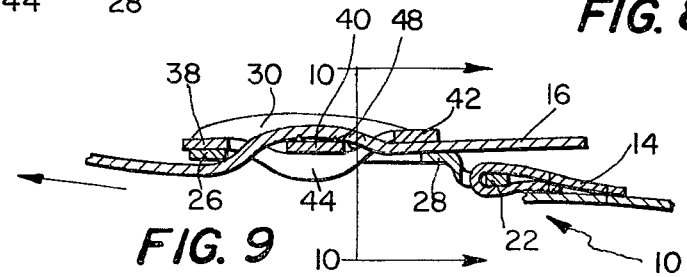
FIG. 9

ADJUSTABLE BUCKLE CONSTRUCTION

BACKGROUND AND SUMMARY OF THE INVENTION

The instant invention relates to detachable fastening devices and more particularly to a novel buckle construction whereby first and second strap end portions are simply and easily detachably interconnectable.

A variety of types of buckle constructions have heretofore been available for interconnecting straps and the like. Most of the heretofore known buckle constructions, however, have been less than completely satisfactory because they have either required substantial manipulation for their operation, they have resulted in marring, scraping, scratching or distorting of one or both of the straps thereby connected, or they have been generally unsuitable for neat and attractive constructions.

The most common type of heretofore known buckle construction comprises a buckle element and a tongue element which is pivotally attached to the buckle element and pivotable towards a cross bar thereof, whereby the tongue element is receivable in an eyelet or aperture in the end portion of a strap to secure the strap to the buckle element. This type of buckle construction has had wide use in a variety of fastening or connecting applications. The primary disadvantage of this type of buckle construction, however, has been in the fact that a substantial amount of manipulation is frequently required to effect the insertion of the buckle tongue thereof into an appropriate eyelet in the strap. Further, it has been found that the straps of such buckles become chaffed and worn after prolonged periods of use and also become distorted around frequently used eyelets therein. Despite these disadvantages, the above-described type of buckle construction has remained relatively popular partially because other more effective fastening devices have simply been unavailable.

The instant invention provides a simple and effective buckle construction which is neat and attractive and which does not cause marring, scraping, scratching or distorting of the straps thereby connected. Specifically, the adjustable buckle construction of the instant invention comprises a base member having spaced first and second cross elements and an open area therebetween and a first strap end portion which is attached to the base member. Also included in the buckle construction is a clasp member having spaced first, second and third cross bars. The clasp member is of slightly smaller transverse dimension and slightly greater longitudinal dimension than the open area of the base member. A second strap end portion is adjustably received in interwoven relation on the clasp member so that the second strap end portion extends upwardly between the first and second cross bars, downwardly between the second and third cross bars, along the underside of the third cross bar and outwardly therefrom. The clasp member with the second end portion attached thereto is receivable on the base member through the open area therein from the underside of the base member so that the first cross bar of the clasp member overlies the first cross element of the base member and so that the free end of the second strap end portion overlies the second cross element of the base member and is interposed between the second cross element and the third cross bar of the clasp member. In the preferred embodiment, side walls are provided on the base member and detents on the side walls releasably lock the clasp member on the base member. The clasp member with the second strap end portion attached thereto is quickly and easily detachably interconnected to the base member in the above described manner, and hence the buckle construction of the instant invention can be effectively used on children's garments and shoes. Specifically because the clasp member is easily received in interfitted relation on the base member, even a child can effect the assembly of the buckle without substantial difficulty. Further, marring, scraping, scratching, or distorting of the strap end portion is eliminated, and the need for eyelets or apertures in the second strap end portion is also eliminated. Consequently, the buckle construction of the instant invention overcomes many of the disadvantages of the buckle assemblies of prior art by providing an attractive buckle construction which is easily operated with a minimal amount of manipulation and which does not cause significant strap damage.

Other types of adjustable fastening devices which represent the closest prior art to the instant invention of which the applicant is aware are disclosed in the U.S. Pat. Nos. to HAZARD, 1,081,610; KING, 1,478,658; RITTER, 1,514,462; JENKINS, 1,648,017; FREYSINGER, 2,784,472; BERNING, 2,924,865; KUBER, 3,064,271 and DAVIS, 3,225,401. Of the above-referred to patents, the patent to HAZARD, 1,081,610 is believed to be the most pertinent, whereas the remainder of the patents referred to are believed to be of general interest only. The device disclosed in the HAZARD patent includes first and second buckle members, the first of which is receivable through a slot or opening in the second buckle member from the underside thereof so that the first buckle member overlies the second buckle member. The buckle construction of the instant invention differs significantly from the HAZARD fastening device in the way the second strap end portion thereof is interwoven on the clasp member, in the dimension of the clasp member relative to the base member, in the overall configurations of the base and clasp member and in the manner in which the clasp member is releasably locked on the base member. The instant invention also has advantages over the HAZARD fastening device in the ease and simplicity of its operation.

Accordingly, it is a primary object of the instant invention to provide a novel, simple and effective buckle construction.

Another object of the instant invention is to provide a buckle construction which can effectively be used on children's garments and shoes.

Another object of the instant invention is to provide a buckle construction for interconnecting first and second strap end portions which does not result in damage to either of said end portions.

A still further object of the instant invention is to provide a buckle construction wherein a clasp member is receivable on a base member to interconnect first and second strap end portions.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention;

FIG. 1 is a perspective view of a shoe which includes a pair of straps which are detachably interconnected with a buckle of the instant invention;

FIG. 2 is a perspective view of the buckle construction of the instant invention in unassembled relation;

FIG. 3 is a perspective view of the buckle construction in assembled relation;

FIG. 4 is an enlarged top plan view of the buckle;

FIG. 5 is a perspective view of the base member of the buckle construction;

FIG. 6 is a perspective view of the clasp member of the buckle construction;

FIGS. 7, 8 and 9 are side elevational views of the buckle construction illustrating the sequential assembly of the clasp and base members thereof; and FIG. 10 is a sectional view taken along line 10—10 in FIG. 9.

DESCRIPTION OF THE INVENTION

Referring now to the drawing, particularly FIGS. 1–4 and 7–10, the buckle construction of the instant invention is illustrated and generally indicated at 10. As illustrated in FIG. 1, the buckle 10 is mounted on a shoe 12 to detachably interconnect the end portion 14 of a first strap or gore to the end portion 16 of an elongated second strap 18, whereby the strap 18 is operable to retain the shoe 12 on the foot of a wearer.

Referring particularly to FIG. 2, it will be seen that the buckle construction 10 of the instant invention comprises a base member generally indicated at 20, to which a loop element 22 is integrally attached, the loop element 22 being attached to the first strap end portion 14. The buckle construction also includes a clasp member 24, the second strap end portion 16 being received in interwoven relation on the clasp member 24. The second strap end portion 16 and the clasp member 24 are receivable on the base member 20 so that the clasp member 24 overlies portions of the base member 20 to detachably interconnect the end portions 14 and 16 as will hereinafter be more fully set forth.

Referring particularly to FIG. 5, the base member 20 is more clearly illustrated and comprises first and second spaced transverse cross elements 26 and 28, respectively, and spaced first and second upstanding side walls 30 and 32, respectively, which interconnect the cross elements 26 and 28 and cooperate therewith to define an open interior area 34 which is of substantially rectangular configuration. The outer periphery of the first cross element 26 is of arcuate configuration to provide an attractive appearance therefor, and similarly the upper peripheries of the side walls 30 and 32 are formed in an arcuate configuration. Detents 36 project inwardly from the side walls 30 and 32 above the open area 34, the detents 26 being longitudinally positioned on the base member 20 so that they are between the transverse center line of the open area 34 and the inner edge of the second cross element 28 for reasons which will be more apparent hereinafter. It is contemplated that in other embodiments of the buckle 10, the use of a roller or the like along the inner edge of the first cross element 26 on the base member 20 may be desirable so that the second end portion will slide freely thereover during the assembly of the buckle members.

The clasp member 24 is most clearly illustrated in FIG. 6 and comprises spaced first, second and third transverse cross bars 38, 40 and 42, respectively, which are interconnected by first and second side walls 44 and 46, respectively, which extend generally downwardly from the ends of the cross bars 38, 40 and 42. The outer peripheries of the first and second cross bars 38 and 42, respectively, are of generally arcuate configurations to provide attractive appearances therefor and prongs or tangs 48 are provided on the upper surface of the second cross bar 40. The clasp member 24 is of slightly smaller transverse dimension and slightly greater longitudinal dimension than the open area 34 so that it is receivable therethrough as will hereinafter be set forth.

The first strap end portion 14 which extends through the loop element 22 to effect the attachment thereof to the base member 20 is illustrated most clearly in FIG. 2. The end portion 14 as herein embodied comprises the terminal portion of a resilient strap element or gore whereby when the clasp member 24 is received on the base member 20 to interconnect the first and second strap end portions 14 and 16, respectively, a slight amount of resilient tension is applied to the foot of a wearer by the strap 18 to retain the shoe 12 thereon. A wide variety of other applications for the buckle 10 are contemplated, however; and hence, it will be understood that the buckle construction of the instant invention can be utilized to interconnect various other types of straps and elements.

The second strap end portion 16 is received in interwoven relation on the clasp member 24 as illustrated in FIGS. 7–9. Specifically, the second strap end portion 16 is received thereon so that it extends under the first cross bar 38, upwardly between the first and second cross bars 38 and 40, respectively, over the second cross bar 40, downwardly between the second and third cross bars 40 and 42, respectively, along the underside of the third cross bar 42 and outwardly therefrom. The prongs 48 penetrate the bottom surface of the second strap end portion 16 slightly to securely retain the end portion 16 in the above described interwoven relation in the clasp member 24.

The assembly of the clasp member 24 and the second end portion 16 with the base member 20 is sequentially illustrated in FIGS. 7–9. As will be seen from FIG. 7, the second strap end portion 16 and the clasp member 24 are first inserted upwardly through the portion of the open area 34 which is between the detents 36 and the first cross element 26. As illustrated in FIG. 8, when the clasp member 24 has passed through the open area 34, the second strap end portion 16 is moved rearwardly slightly causing the first cross element 26 to be received between the first cross bar 38 and the second strap end portion 16. As the second strap end portion 16 is further moved rearwardly, the first cross bar 38 engages the first cross element 26 and the clasp member 24 is thereby urged downwardly. The clasp member 24 is then pressed downwardly by the user causing the side walls 44 and 46 to pass between the detents 36. In this regard, the detents 36 are positioned on the base member 20 so that when the clasp member 24 reaches a fully downwardly pressed position on the base member 20, they engage the upper edges of the side walls 44 and 46 between the second and third cross bars 40 and 42, respectively, to lock the clasp member 24 in position. This defines the closed or locked position of the buckle 10 illustrated in FIG. 9, wherein the first cross bar 38 overlies the first cross element 26 at one of the ends of the buckle 10 and the second strap end portion 16 is interposed between the third cross bar 42 and the second cross element 28 at the opposite end thereof. The closed or locked position of the buckle 10 is also illustrated in FIGS. 1, 3, 4 and 10.

The clasp member 24 and the second end portion 16 are disassembled from the base member 20 by the reverse sequence of operations. Specifically, the terminal end of the second strap end portion 16 is lifted upwardly causing the side walls 44 and 46 to pass by the detents 36, and thereafter the clasp member 24 is advanced forwardly to allow the first cross bar 38 to pass under the first cross element 26. The clasp member 24 and the end portion 16 are then fed downwardly through the open area 34 to the unassembled position of the buckle 10 as illustrated in FIG. 2.

It is seen therefore that the instant invention provides a novel and effective buckle construction which is operable with a minimal amount of manipulation, and hence can even be operated by small children. The buckle 10 is attractive and effective and does not require a tongue element or the use of eyelets in the strap 18. Further, the buckle 10 can effectively retain the strap 18 without causing scoring or scratching of the upper surface thereon and hence the attractiveness of the strap 18 is preserved indefinitely. Accordingly, the buckle construction of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An adjustable buckle construction comprising:

(a) first strap end portion;

(b) a base member having spaced first and second cross elements with an open interior area therebetween, a loop element adjacent said second cross element and a pair of spaced side walls which extend upwardly adjacent opposite side edges of said open area;

(c) means securing said first strap end portion to said loop element;

(d) a second strap end portion;

(e) a clasp member having spaced first, second and third transverse cross bars, said clasp member being of slightly smaller transverse dimension and slightly greater longitudinal dimension than said base member open area, and having a pair of spaced side walls which extend downwardly between said cross bars on the sides of said clasp member, said second strap end portion being received in interwoven relation on said clasp member so that it extends upwardly between said first and second cross bars, downwardly between said second and third cross bars, across the underside of said third cross bar and outwardly therefrom, said clasp member being received on said base member through said open area from the underside of said base member so that said first cross bar overlies said first cross element and so that the free end of said second strap end portion overlies said second cross element and is interposed between said second cross element and said third cross bar and extends outwardly therefrom; and (f) detent means on said base member side walls engaging the upper edges of said clasp member side walls between said second and third cross bars thereof and thereby releasably locking said clasp member on said base member.

* * * * *